US007198339B2

(12) United States Patent
Baron

(10) Patent No.: US 7,198,339 B2
(45) Date of Patent: Apr. 3, 2007

(54) BATHROOM STORAGE SYSTEM

(76) Inventor: Bert Baron, 173 So. Angel St., Layton, UT (US) 84041

( * ) Notice: Subject to any disclaimer, the term of this patent is extended or adjusted under 35 U.S.C. 154(b) by 226 days.

(21) Appl. No.: 10/928,802

(22) Filed: Aug. 30, 2004

(65) Prior Publication Data

US 2006/0043847 A1 Mar. 2, 2006

(51) Int. Cl.
*E03C 1/18* (2006.01)

(52) U.S. Cl. ..... 312/228; 312/209; 312/351

(58) Field of Classification Search ..... 312/204, 312/206, 207, 209, 224, 351, 228, 228.1, 312/229, 237, 223.1, 321.5, 326, 329, 274, 312/276

See application file for complete search history.

(56) References Cited

U.S. PATENT DOCUMENTS

| | | | | | |
|---|---|---|---|---|---|
| 189,942 | A * | 4/1877 | Kirkwood | 312/227 |
| 932,054 | A * | 8/1909 | McPherson | 4/626 |
| 1,443,858 | A * | 1/1923 | Windecker | 312/227 |
| 1,505,355 | A * | 8/1924 | Larsen | 312/328 |
| 2,731,318 | A * | 1/1956 | Hoff | 312/210 |
| 3,292,983 | A * | 12/1966 | Service | 312/228 |
| 4,241,963 | A * | 12/1980 | Seidel | 312/228 |
| 4,691,837 | A * | 9/1987 | Dillon | 220/890 |
| 5,123,515 | A * | 6/1992 | Zeller | 193/2 R |
| 5,370,452 | A * | 12/1994 | Baer | 312/24 |
| 5,377,866 | A * | 1/1995 | Watters, II | 221/194 |
| 5,743,415 | A * | 4/1998 | Smart | 211/70.6 |
| 6,109,446 | A * | 8/2000 | Foote | 206/759 |
| 6,378,537 | B1 * | 4/2002 | DeHart | 134/115 R |
| 6,769,554 | B1 * | 8/2004 | Udofiah | 211/70.6 |
| 6,820,755 | B1 * | 11/2004 | Ranjit | 211/70.6 |

* cited by examiner

*Primary Examiner*—Janet M. Wilkens

(57) ABSTRACT

A bathroom storage system convenient for storage of hair care items, such as hair blowers and hair curling irons wherein receptacles are positioned in a bathroom cabinet to extend around the sink and into the normally unused upper space of the cabinet; the items being inserted into the receptacles and retrieved from the receptacles through a pivoting front panel and having inserted tubes projecting from inner ends to receive hot tips of hair curling irons and the like; and the receptacles being cantilevered from a front face of the cabinet, with a pivoted lip of each receptacle secured to the front face and hinge connections allowing the receptacles to extend angularly downwardly from the front panel.

10 Claims, 4 Drawing Sheets

BATHROOM STORAGE SYSTEM

CROSS-REFERENCE TO RELATED APPLICATIONS

Figure 1:
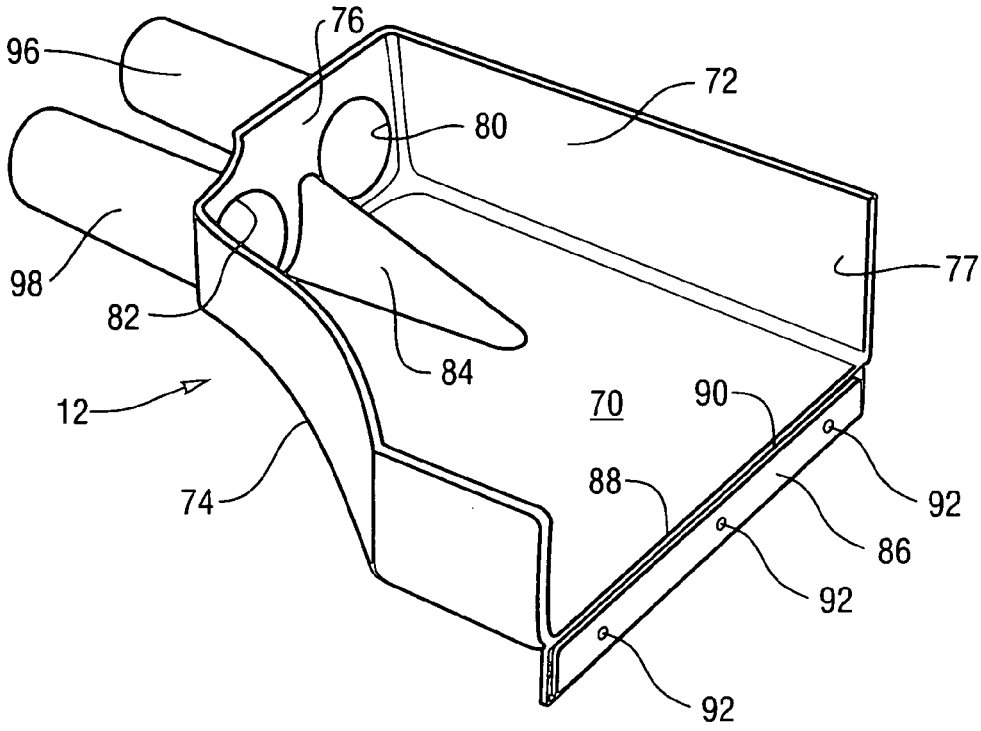

Not Applicable.

STATEMENT REGARDING FEDERALLY SPONSORED RESEARCH OR DEVELOPMENT

Not Applicable.

REFERENCE TO MICROFICHE APPENDIX

Not Applicable.

BACKGROUND OF THE INVENTION

1. Field of the Invention

This invention relates to bathroom cabinets having storage compartments in normally unused space within the cabinets.

2. Description of the Related Art

Vanity sinks for bathroom use have generally included a cabinet with a top counter surface and a hole through the counter surface into which a vanity sink is positioned. The cabinet may have storage areas beneath the countertop, but such areas are generally accessible through doors on the face of the cabinet and that open into lower areas, generally well below the bottom of the vanity sink. Normally, a face panel or "false front" is fixed across the front of the cabinet, above the access doors, that provide access to the storage space beneath the vanity sink.

A number of U.S. patents have disclosed ways to use some of the normally unused storage space that is adjacent to a vanity sink mounted in a bathroom cabinet.

It has been recognized in the past that various types of storage can be provided in the space between the front panel or false front of the cabinet and a sink positioned in the countertop of such cabinet. To accommodate the storage, the panel or false front across the front of the cabinet and above the access doors that provide normal storage to the cabinet, is frequently hinged to provide access to a receiving receptacle formed immediately behind the hinged front panel. Generally, the hinges are placed at the bottom of the front panel and as the door swings open, the receptacle becomes accessible to receive articles placed therein. Most often, the receptacle fixed to the pivoted front panel, is rather shallow and is elongated to extend across the front of the cabinet and between the front panel and the sink. Articles placed in the receptacle must fit within the confines of the shallow, elongated receptacle.

THE INVENTION

It has been known to make the "false front", i.e., the front panel located above the access doors and beneath the countertop of a bathroom vanity cabinet to pivot open for access to an upper front portion of the interior of the cabinet. It has not been known that such a pivoted panel structure can be used to provide access to receptacles suspended within the vanity structure and that extend around and beneath a sink. Neither has it been known to provide receptacles that extend downwardly from the front of the cabinet and that are particularly adapted to receive hot hair shaping tools, such as a hot hair blower and one or more hair curling irons.

OBJECTS OF THE INVENTION

Principal objects of the present invention are to provide storage receptacles utilizing the available space to the sides of and beneath the sink mounted in a bathroom cabinet.

Another object is to position the receptacles to safely receive the heated ends of hair conditioning and shaping tools, such as a hair blow dryer and one or more hair curling irons.

Still another object is to make the false front or front panel located above the usual swinging access door to the lower portion of the cabinet, pivot outwardly sufficiently far to allow for insertion and removal of the hair conditioning and shaping tools.

It is also an object to provide receptacles preferably made of a low cost, but durable and strong plastic with heat dissipating receiving tubes for hot tip ends that will not burn or melt when the hot tips of hair curler irons are inserted therein.

FEATURES OF THE INVENTION

Principal features of the invention include receptacles shaped to fit beneath the counter of a bathroom vanity and around the bottom of a sink mounted in said countertop and that are counter lever mounted to project into the vanity. The receptacles are secured to face structure of the vanity and are cantilevered into the cabinet space. The receptacles have open backs to allow insertion of hair care articles to be stored in the receptacles. A hinge pivoted false front or front panel pivots to at least a full ninety degrees from the face of the vanity to allow full access into the receptacles.

At least one of the receptacles includes at least one tubular receiving end, made of metal, ceramic, heat resistant plastic, or the like, at the front of the receptacle. The hot ends of articles to be stored can be inserted into the tubular receiving ends. The receptacles include curved side portions that will fit closely around a sink bottom and a side and an end wall that will retain the articles placed in the receptacles.

Additional objects and features of the invention will become apparent to a person skilled in the art to which the invention pertains from the following detailed description and claims.

BRIEF DESCRIPTION OF THE FIGURES OF THE INVENTION

In the Drawings

Figure 2:
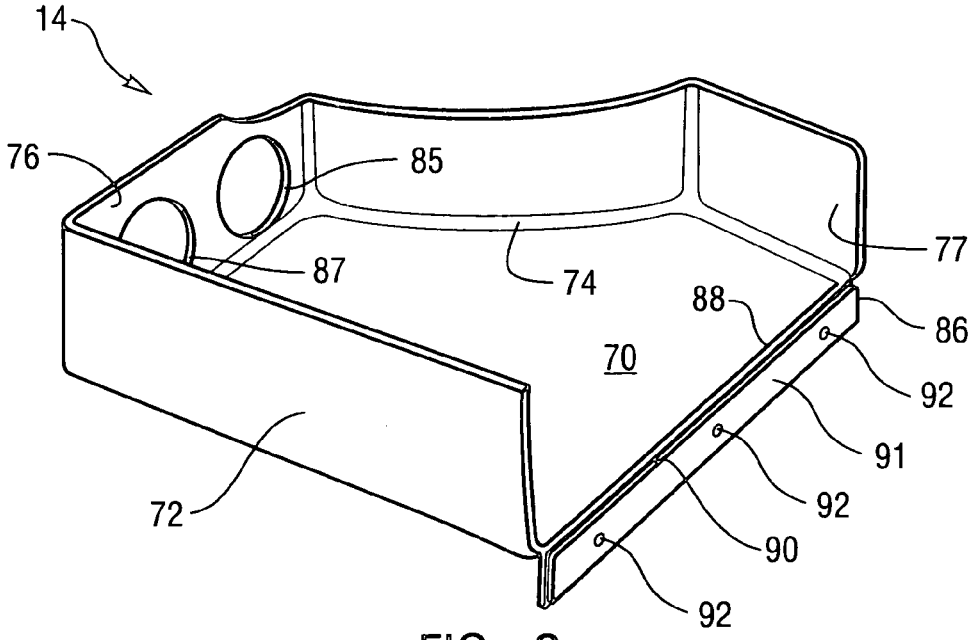
Figure 3:
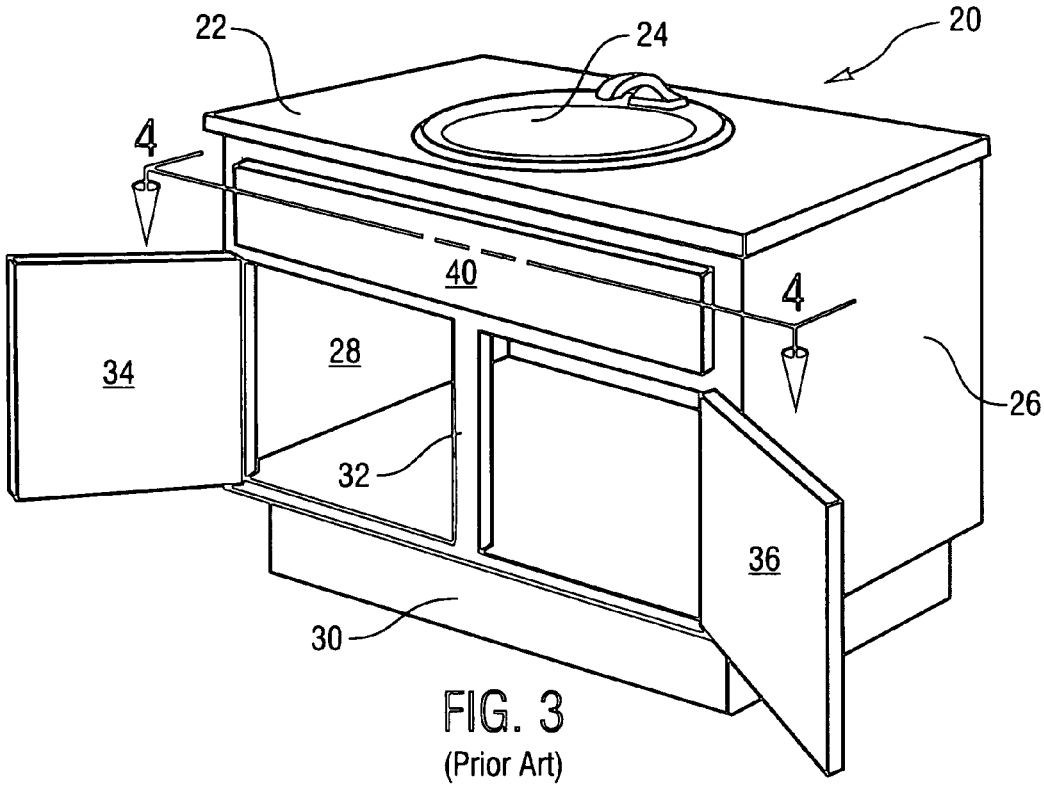
FIG. 3 (Prior Art)
Figure 4:
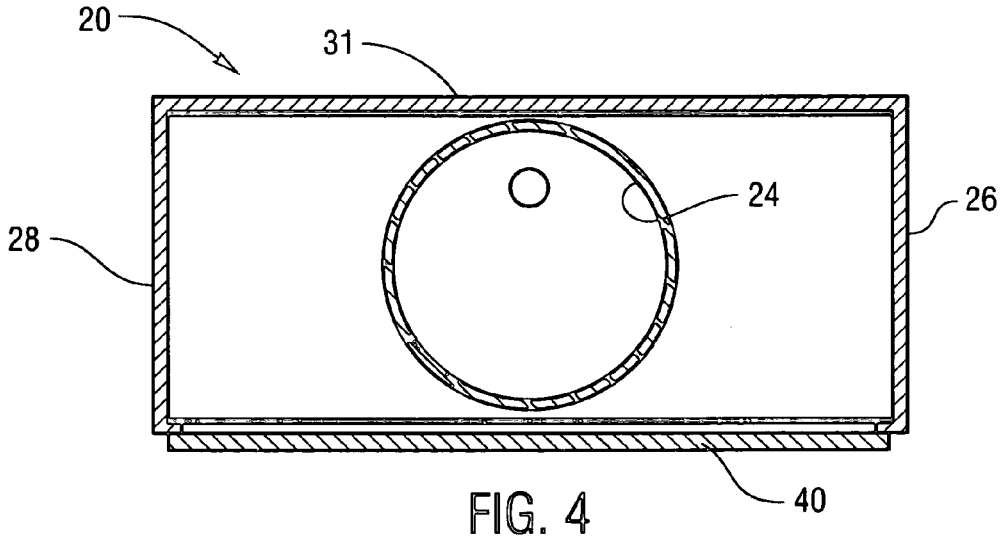
FIG. 4 (Prior Art)
Figure 5:
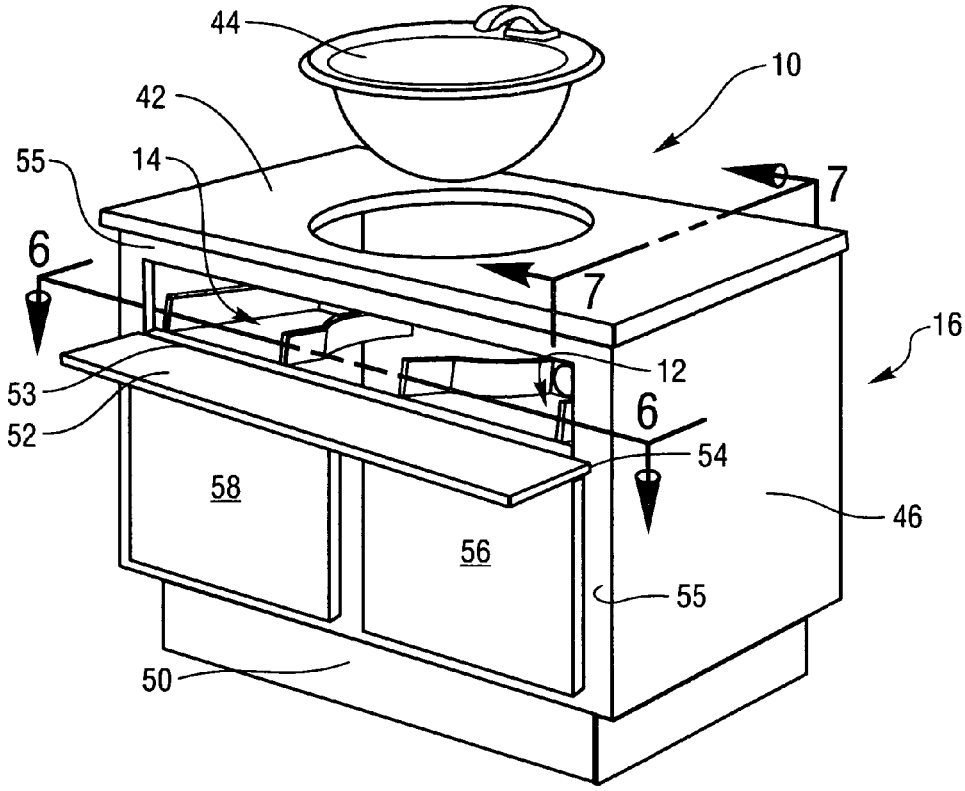
Figure 6:
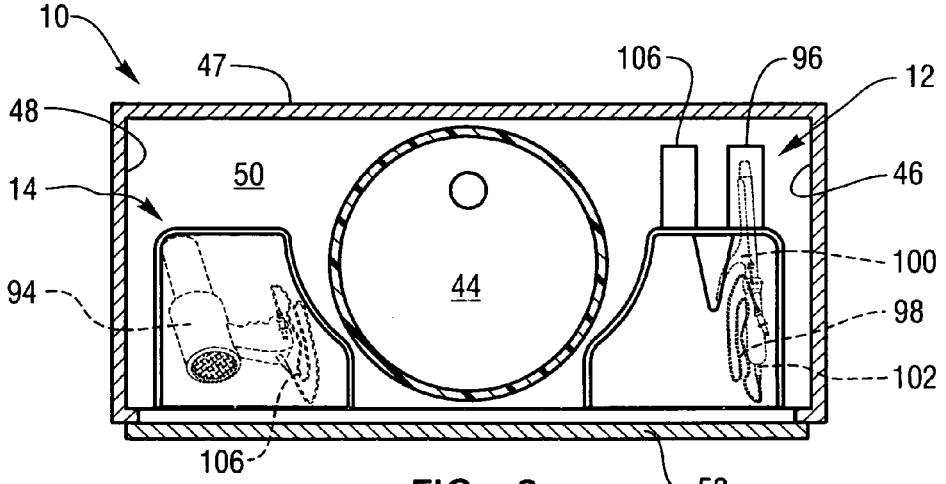
Figure 7:
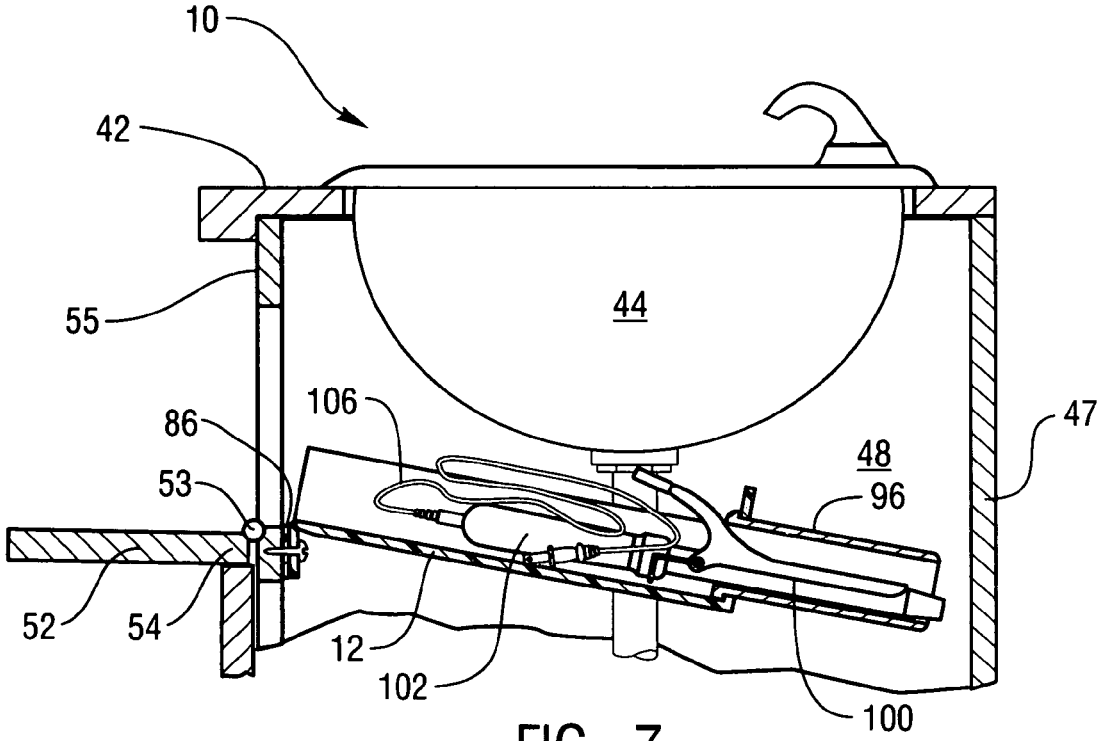
Figure 8:
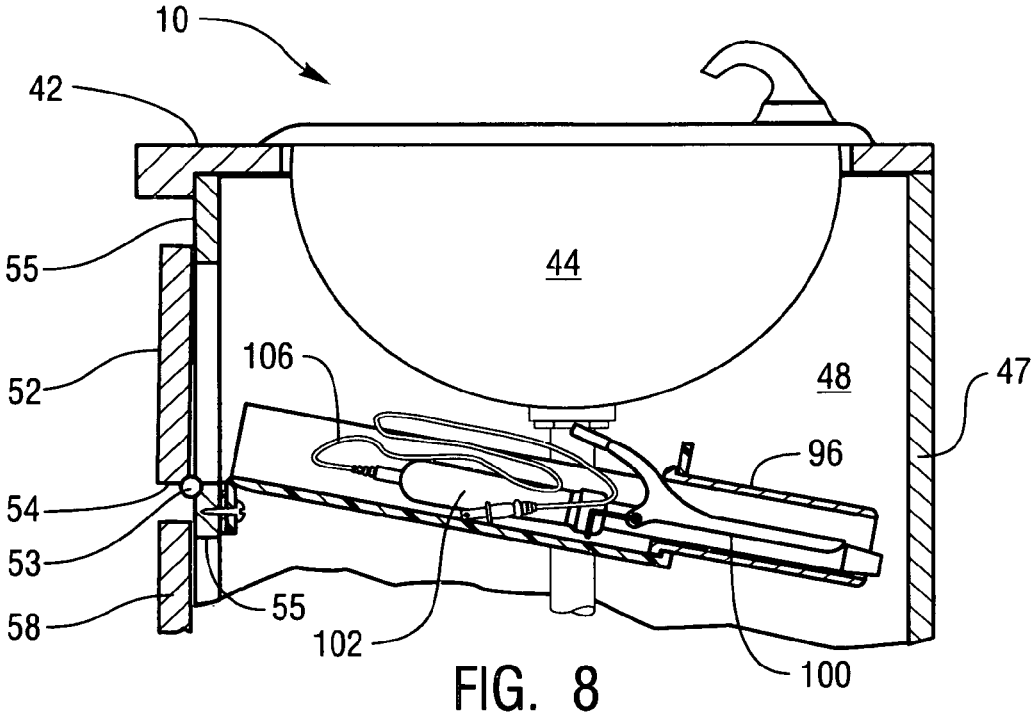

FIG. 1 is a perspective view of one receptacle of the invention;

FIG. 2, a perspective view of another receptacle of the invention;

FIG. 3, a perspective view of a conventional bathroom vanity;

FIG. 4, a horizontal section taken on the line 4—4 of FIG. 3;

FIG. 5, a perspective view of a vanity of the present invention with the sink shown exploded from the cabinet;

FIG. 6, a horizontal section taken on the line 6—6 of FIG. 5;

FIG. 7, a vertical section taken on the line 7—7 of FIG. 5 and showing the pivoted front panel in an open condition; and FIG. 8, a view like that of FIG. 7, but showing the pivoted front panel in a closed condition.

DETAILED DESCRIPTION

Referring Now the Drawings

In the illustrated preferred embodiment of the invention, the bathroom storage system 10 includes a pair of receptacles 12 and 14. The receptacles 12 and 14 are incorporated into a bathroom vanity cabinet 16 (FIGS. 5 and 8) and together provides the bathroom storage system 10 of the invention.

As shown in FIGS. 3 and 4, conventional bathroom vanities include a cabinet 20 having a countertop 22 into which a sink 24 is recessed. The cabinet has the usual sides 26 and 28 and a base 30, which supports the cabinet 20 above ground level.

The sink 24 is positioned to rest on the countertop and extends downwardly into the cabinet 20.

The cabinet 20 has the usual rear wall 31 interconnecting sidewalls 26 and 28 and a front frame work 32 that supports the usual swinging doors 34 and 36. A face panel or "false front" 40 is mounted to the front frame work 32 above the doors 34 and 36.

The present invention is best shown in FIGS. 5–8. As shown, a bathroom vanity of the invention comprises the cabinet 16 having a countertop 42 into which a sink 44 is recessed. The cabinet has sides 46 and 48 and a base 50 which supports the cabinet 16 above ground level.

The sink 44 is positioned to rest on the countertop and extends downwardly into the cabinet 16. A front panel 52 is pivotally connected by a hinge 53 at a lower edge 54 to a front frame 55 interconnecting end sides 46 and 48, a back 47 and the base 50. The front panel 52 thus pivots from a closed position against the front frame 55 to a fully open position extending at approximately 90 degrees from the front frame of the cabinet 16.

Swinging doors 56 and 58 are hinge pivoted to the front frame 55 in conventional manner to provide access to the lower interior of cabinet 16.

The receptacles 12 and 14 are mounted to the front frame 55 and extend into the cabinet 16 beneath the outer rim of the sink 44 and into the space extending around and immediately beneath the sink. The receptacles 12 and 14 each have bottom support surface 70, a sidewall 72 extending around and upwardly from a portion of the bottom. A curved portion 74 of sidewall 72 will follow closely around the curve of the sink 44. The wall 72 extends upwardly from a flat bottom surface 70 at two sides and across an inner end 76 of each of the receptacles 12 and 14.

Thus formed, the receptacles each have open back ends 77 through which objects to be stored in the receptacles are inserted.

A pair of spaced apart holes 80 and 82 are formed in the wall 72 that extends across the inner end 76 of at least one of the receptacles. As shown, the spaced apart holes 80 and 82 are formed in the wall 72 of receptacle 12. A divider 84 engages the wall 72 and extends into receptacle 12 to guide articles placed in the receptacle 12 into the spaced apart holes 80 and 82. As shown, spaced apart knock-outs 85 and 87 that can be easily removed are provided in the wall 72 of receptacle 14 at the inner end 76.

Each of the receptacles 12 and 14 has a lip 86 extending across the edge 88 of the flat bottom surface 70, at the open back end 79 of the receptacle.

Lips 86 are each connected to a receptacle 12 or 14 by a limited flexure hinge 90 and extend downwardly from the bottom 70. The surfaces of the lips remote from the bottom 70 have an adhesive surface 91 and a series of spaced apart holes 92 are formed through each lip and adhesive surface.

The lips 86 are secured to the front frame 55 above the doors 56 and 58 with the curved portions 74 of the sidewalls of the receptacles extending around the bottom of the sink 44. The lips 86 are adhesively bonded to the front frame and may also be secured by screws inserted through the holes 92 and into the front frame. The receptacles are cantilevered into the cabinet 16 and the front panel 52, when closed, hides the receptacles and articles placed therein from view. The receptacles are preferably cantilevered downwardly from the front plates at an angle of between about fifteen and twenty-five degrees for easy insertion and removal of articles.

When the front panel 52 is pivoted to its open position, access is provided to the rear (or receiving) open ends of the receptacles 12 and 14 and articles may be inserted into or taken out of the receptacles. A hair blower 94, for example, is conveniently positioned in one of the receptacles 12 or 14.

Tubes 96 and 98 project from holes 80 and 82 and are made of metal, ceramic or heat resistant plastic, or other material, that will not burn or melt when subjected to heat. Consequently, the hot tips 100 of hair curler irons 102, or the like, inserted into receptacle 12 and into the tubes 94 and 98 can be left to cool without danger of fire or other damage to the receptacle. Knock-outs 85 and 87 are easily removed and tubes 96 and 98 are easily installed to project from receptacle 14, if desired. Cords 106 of inserted hair blower 96 and hair curler irons 102 are easily stored in receptacle 12 and/or 14.

Although preferred forms of my invention have been herein disclosed, it is to be understood that the present disclosure is by way of example and that variations are possible without departing from the subject matter coming within the scope of the following claims, which subject matter I regard as my invention.

I claim:

1. A bathroom storage system comprising a cabinet having a top counter, back and side walls and a front frame with openings through said front frame to the interior of said cabinet, doors covering a lower portion of said front frame, and a front panel extending across said front frame above said doors;

a hinge interconnecting a bottom of said front panel to said front frame, said hinge allowing said front panel to pivot from flush against said front frame downwardly to extend outwardly at a right angle to said front frame; and at least one receptacle having a bottom, a wall around said sides and an inner end of said bottom, one of said sides and said bottom being partially curved to extend around a lower portion of a sink and said receptacle extending into the cabinet and angularly downward from connection with said front frame.

2. A bathroom storage system as in claim 1, wherein the at least one receptacle has at least one heat dissipating cylinder opening into said receptacle and projecting from the wall closing one end of said receptacle.

3. A bathroom storage system as in claim 2, wherein each receptacle is extendable into the cabinet beneath the edge of the sink and downwardly at an angle of between about fifteen and twenty-five degrees.

4. A bathroom storage system as in claim 3, wherein each receptacle has a lip bonded and attached by screws to an inner surface of the front frame.

5. A bathroom storage system as in claim 1, wherein the at least one receptacle comprises a pair of receptacles cantilevered mounted to and extending inwardly of the cabinet and angling downwardly from the front frame, each said receptacle of said pair of receptacles having a bottom with a cut-away curved side portion to extend around the sink in the cabinet and an upstanding sidewall around the sides and inner end of said bottom.

6. A bathroom storage system as in claim 5, wherein at least one of said pair of receptacles has a heat dissipating cylinder opening into said receptacle at an end opposite the hinged front panel, said cylinder projecting beyond the end of the bottom and the sidewall projecting upwardly therefrom.

7. A bathroom storage system as in claim 6, wherein all components except for each heat dissipating cylinder are made of substantially rigid and durable plastic.

8. A bathroom storage system as in claim 7, wherein each receptacle has a front lip connected to the front frame by adhesive and screws.

9. A bathroom storage system as in claim 8, wherein the front lip of each receptacle is hinge connected to the bottom of said receptacle.

10. A bathroom storage system as in claim 9, wherein each hinge connected to the lip and the bottom of a receptacle has a limited flexure to limit the downward angle of the receptacle extending into the cabinet.

* * * * *